US007899357B2

(12) United States Patent
Leemhuis et al.

(10) Patent No.: US 7,899,357 B2
(45) Date of Patent: Mar. 1, 2011

(54) REINFORCED DOCTOR BLADE ASSEMBLY SEAL AND PRINTER CARTRIDGE EMPLOYING THE REINFORCED SEAL

(75) Inventors: James Richard Leemhuis, Lexington, KY (US); Benjamin Keith Newman, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 44 days.

(21) Appl. No.: 12/344,912

(22) Filed: Dec. 29, 2008

(65) Prior Publication Data

US 2010/0166452 A1 Jul. 1, 2010

(51) Int. Cl.
*G03G 15/08* (2006.01)

(52) U.S. Cl. ..... 399/103

(58) Field of Classification Search ..... 399/102, 399/103, 105, 106

See application file for complete search history.

(56) References Cited

U.S. PATENT DOCUMENTS 6,188,421 B1 * 2/2001 Hayashi et al. ..... 399/106 X
6,792,227 B2 * 9/2004 Itabashi ..... 399/105
6,975,342 B2 * 12/2005 Dougherty ..... 347/214
7,630,666 B2 * 12/2009 Nakaya et al. ..... 399/103
7,680,430 B2 * 3/2010 Mori et al. ..... 399/103
2002/0150402 A1 * 10/2002 Buchanan et al. ..... 399/103
2008/0145093 A1 * 6/2008 Fukuta et al. ..... 399/103

* cited by examiner

*Primary Examiner*—Sophia S Chen
(74) *Attorney, Agent, or Firm*—Justin M. Tromp; John Victor Pezdek

(57) ABSTRACT

A reinforced doctor blade assembly seal for use in a printer cartridge includes a base strip of a flexible plastic film having a thickness, a surface of predetermined area bounded by multiple edges, and a foldable region extending length-wise between one pair of the multiple edges and spaced from and located intermediately between another pair of the multiple edges. The seal includes a supplemental strip of a flexible plastic film having a thickness and a surface of predetermined area bounded by multiple edges. The supplemental strip is laminated on the base strip offset from and along one side of the foldable region on the base strip such that the base strip has adjacent laminated and non-laminated portions along opposite sides of the foldable region with the laminated portion having a greater thickness than the non-laminated portion. The seal has an adhesive coating on the non-laminated portion of the base strip.

28 Claims, 5 Drawing Sheets

REINFORCED DOCTOR BLADE ASSEMBLY SEAL AND PRINTER CARTRIDGE EMPLOYING THE REINFORCED SEAL

CROSS REFERENCES TO RELATED APPLICATIONS

None.

BACKGROUND

1. Field of the Invention

The present invention relates generally to an image forming device and, more particularly, to a reinforced doctor blade assembly seal and a printer cartridge employing the reinforced seal.

2. Description of the Related Art

An image forming device, such as a laser printer and the like, includes a drum having a photoconductive outer cylindrical surface charged to a uniform electrical potential and then selectively exposed to light in a pattern corresponding to an original image. Those areas of the photoconductive surface exposed to light are discharged thus forming a latent electrostatic image thereon. A developer material, such as toner, having an electrical charge such that the toner is attracted to the discharged area of the photoconductive surface operates in contact with the photoconductive surface. The drum developed image then rotates toward a transfer station. A recording sheet is then brought into contact with the photoconductor and the toner thereon is transferred to the recording sheet in the form of the latent electrostatic image. The recording sheet is then heated, permanently fusing the toner to the sheet. In preparation for the next image forming cycle, the photoconductive surface of the drum is cleaned of residual toner and recharged. U.S. Pat. No. 6,990,308, assigned to the assignee of the present invention, discloses an image forming device having the aforementioned configuration. The disclosure of this patent is hereby incorporated herein by reference thereto.

Typically, as seen in the cited patent, the toner is stored in a toner well or reservoir of a printer cartridge located adjacent to the drum. A doctor blade assembly and a developer roll of a developer unit, which is part of the printer cartridge, are positioned between the toner reservoir and the drum for controlling the amount of toner delivered to the drum. A nip created between the doctor blade of the doctor blade assembly and the developer roll controls the thickness of the toner layer formed on the developer roll. To be able to print correctly, toner must be evenly distributed, or doctored, out in a thin uniform layer onto the developer roll in the proper thickness. This function is performed by the doctor blade.

Referring to FIGS. 1, 2A and 2B herein, there is partially shown in FIGS. 2A and 2B the printer cartridge 10 in which a seal 12 in the form of an elongated strip of a flexible plastic film is positioned between the doctor blade assembly 14 and a portion of a housing 16 of the printer cartridge 10. The housing portion is in the form of a corner 16*a* on the housing 16. The strip of film comprising the seal 12, shown by itself in FIG. 1, is a bi -axially-oriented PET (boPET) polyester film material, marketed under the trademark Mylar. It is positioned in a space or gap 18 between the doctor blade assembly 14 and the corner 16*a* on the cartridge housing 16 in order to prevent leaking of toner from between these components through this gap 18. Referring to FIG. 1 herein, this seal, generally designated 12, is shown by itself. In FIG. 2A the seal 12 is shown correctly installed and positioned in the printer cartridge 10, closing the gap 18 between a bracket 20 of the doctor blade assembly 14 and the housing 16 of the printer cartridge 10.

The developer roll 22, a toner adder roll 24 and the doctor blade assembly 14, with the doctor blade 26 mounted by the bracket 20, make up the developer unit 28 and are mounted on the housing 16 of the printer cartridge 10, as shown in FIGS. 2A and 2B. The quantity of toner in the toner reservoir of the printer cartridge 10 is depleted through use in the printing operation. Thus the printer cartridge 10 is a consumable item which must be replaced periodically in the image forming device. Being a consumable, the printer cartridge 10 must be designed and manufactured to withstand rough handling during shipping, separate from the printer, through the supply chain to a customer and installation into an image forming device. The printer cartridge 10 has the potential to be dropped and thus exposed to large shock forces during shipping separate from the printer.

Dropping the printer cartridge 10 can lead to excessive toner leaks from behind the doctor blade assembly bracket 20 due to internal pressure forcing the doctor blade assembly seal 12 to blow out and dislocate from its correct sealing position, as seen in FIG. 2A, to the blown-out position, as seen in FIG. 2B. A photograph of the blown-out position of the seal 12 replicated by a drop test is shown in FIG. 2C. This blow out and dislocation of the seal 12 causes two problems. First, when the seal 12 is pushed out over the doctor blade assembly 14 as shown in FIG. 2C, its sealing integrity is lost and toner can easily leak from the printer cartridge 10. Second, as shown in FIG. 2B the seal 10 may assume a wedged condition upstream of the gap 18 and on top of the doctor blade assembly 14 where it applies increased downward force onto the doctor blade 26, adversely affecting the doctoring performance of the doctor blade 26.

One proposed solution for avoidance of the blow out problem has been to use a seal in the form of a strip of foam material, rather than of the boPET polyester material, behind the doctor blade assembly. However, the presence of the foam tends to prevent the doctor blade 26 from translating smoothly against the developer roll 22. Also, the foam causes more leak paths to propagate than the boPET polyester seal, requiring the application of wax to fill the anticipated leak paths.

Thus, there is a continuing need for an innovation that will provide effective sealing between the doctor blade assembly and the housing of the printer cartridge.

SUMMARY OF THE INVENTION

The present invention meets this need by employing an innovation involving the reinforcement of the prior art seal through its partial lamination with a supplemental strip of smaller size to provide a reinforced seal. The robustness of the printer cartridge incorporating the reinforced seal of the present invention is increased to withstand shock from rough shipping and handling of the printer cartridge to a customer, with no compromise of its sealing function. Partial lamination with the smaller size supplemental strip provides the reinforced seal with laminated and non-laminated portions having different thicknesses which improves printer cartridge robustness and provides extra rigidity allowing for easier and more accurate installation of the reinforced seal.

Accordingly, in an aspect of the present invention, a doctor blade assembly seal includes a base strip of a flexible plastic film having a thickness and a surface of predetermined area bounded by multiple edges, and a supplemental strip of a flexible plastic film having a thickness and a surface of predetermined area bounded by multiple edges. The base strip also has a foldable or flexible region extending length-wise of the base strip between one pair of the multiple edges and spaced from and located intermediately between another pair of the multiple edges. The flexible plastic film of the supplemental strip is laminated onto the flexible plastic film of the base strip offset from and along one side of the foldable region such that the base strip has laminated and non-laminated portions with different thicknesses along opposite sides of the foldable region on the base strip. The reinforced seal also includes an attaching mechanism, such as an adhesive coating, on at least a section of the non-laminated portion of the base strip extending between the one pair of multiple edges of the base strip. The thickness of the supplemental strip is within a range of from three to four times greater than the thickness of the base strip. The multiple edges of the base strip correspond to and are longer than the multiple edges of the supplemental strip such that the surface of the base strip is substantially U-shaped and borders the supplemental strip along a plurality of the multiple edges of the supplemental strip. At least a portion of the U -shaped surface on the base strip has the adhesive coating thereon.

In another aspect of the present invention, a printer cartridge includes a housing having a reservoir for holding toner, a developer roll supported by the housing and operable to receive toner from the reservoir and transfer the toner to a photoconductive drum, a doctor blade assembly supported by the housing adjacent to the developer roll and having a doctor blade and a bracket for positioning the doctor blade to form a nip with the developer roll to control the amount of toner metered onto the developer roll, the bracket also disposed adjacent a portion of the housing such that a gap is defined between the bracket and the housing portion, and the above-described reinforced seal disposed through the gap to provide sealing of the gap between the bracket and the housing portion to prevent potential leakage of toner in a predetermined direction of flow through the gap and from the printer cartridge. The adhesive coating on the non-laminated portion of the base strip adapts the reinforced seal at the non-laminated portion for attachment to the housing at least downstream of the gap.

BRIEF DESCRIPTION OF THE DRAWINGS

Figure 1:
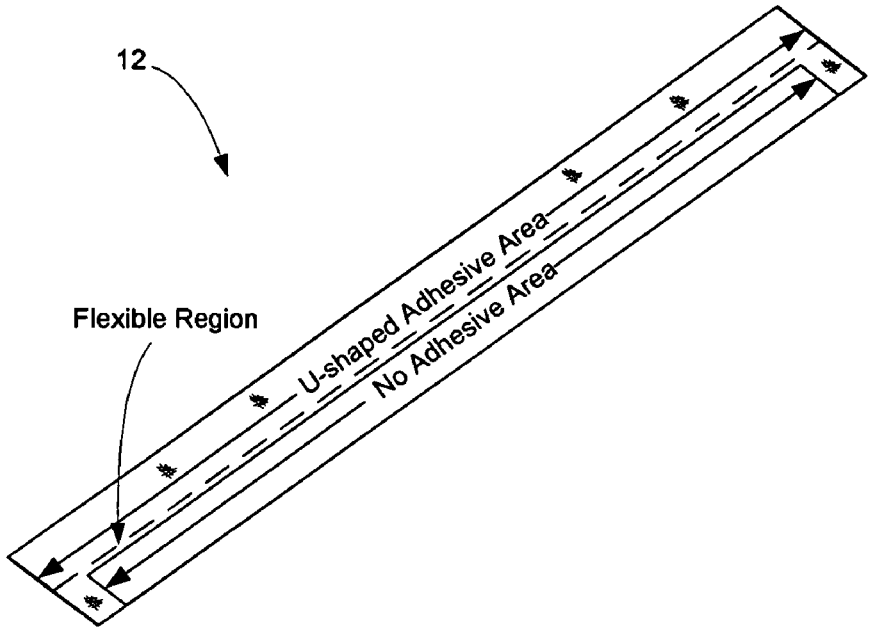
FIG. 1 Prior Art

Having thus described the invention in general terms, reference will now be made to the accompanying drawings, which are not necessarily drawn to scale and in some instances portions may be exaggerated in order to emphasize features of the invention, and wherein:

FIG. 1 is a perspective view of a prior art doctor blade assembly seal.

Figure 2A:
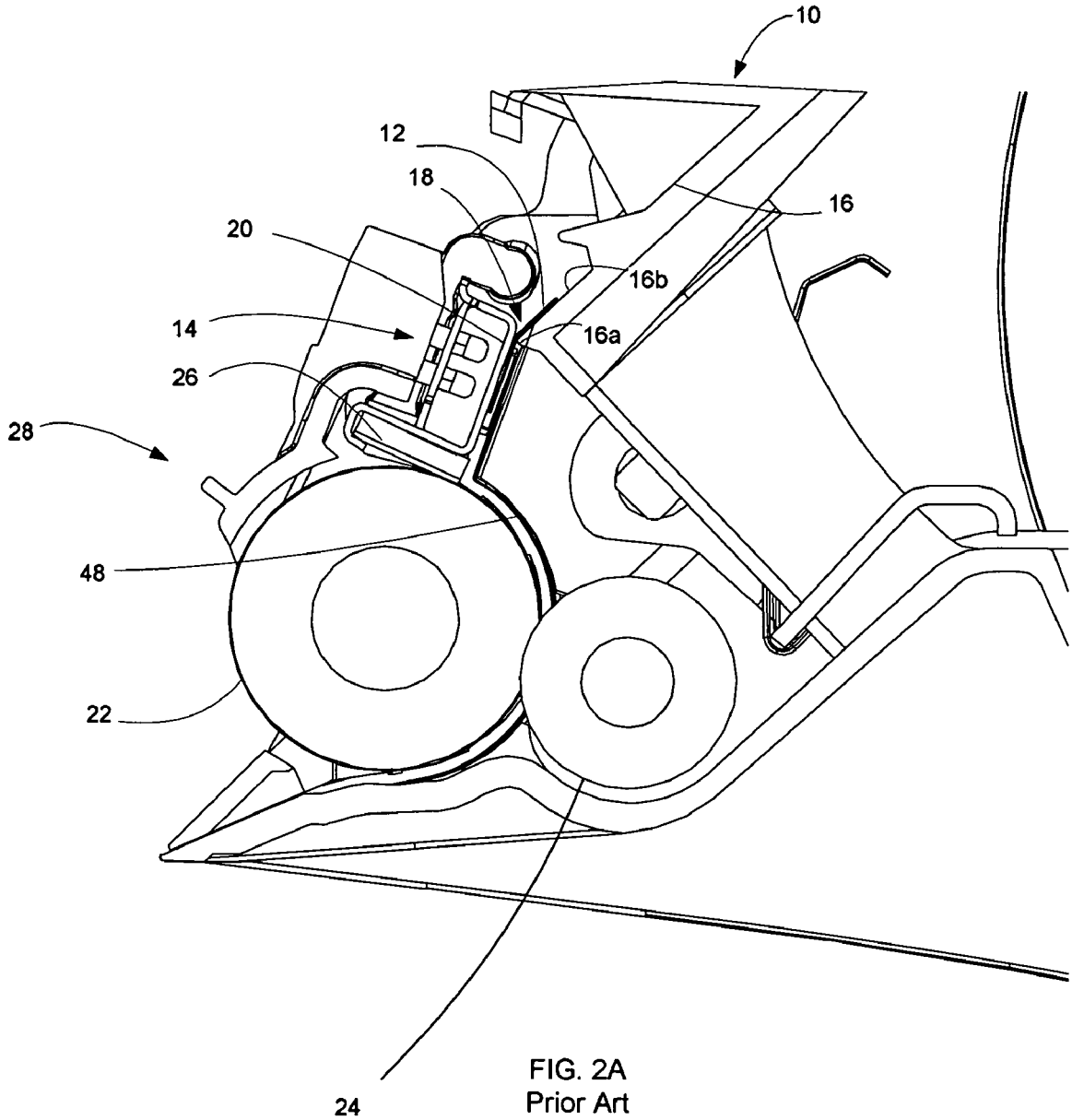
FIG. 2A Prior Art

FIG. 2A is a side elevational view of a portion of a printer cartridge depicting correct positioning of the prior art seal of FIG. 1 in a gap between a doctor blade assembly and a corner on a housing of the printer cartridge.

Figure 2B:
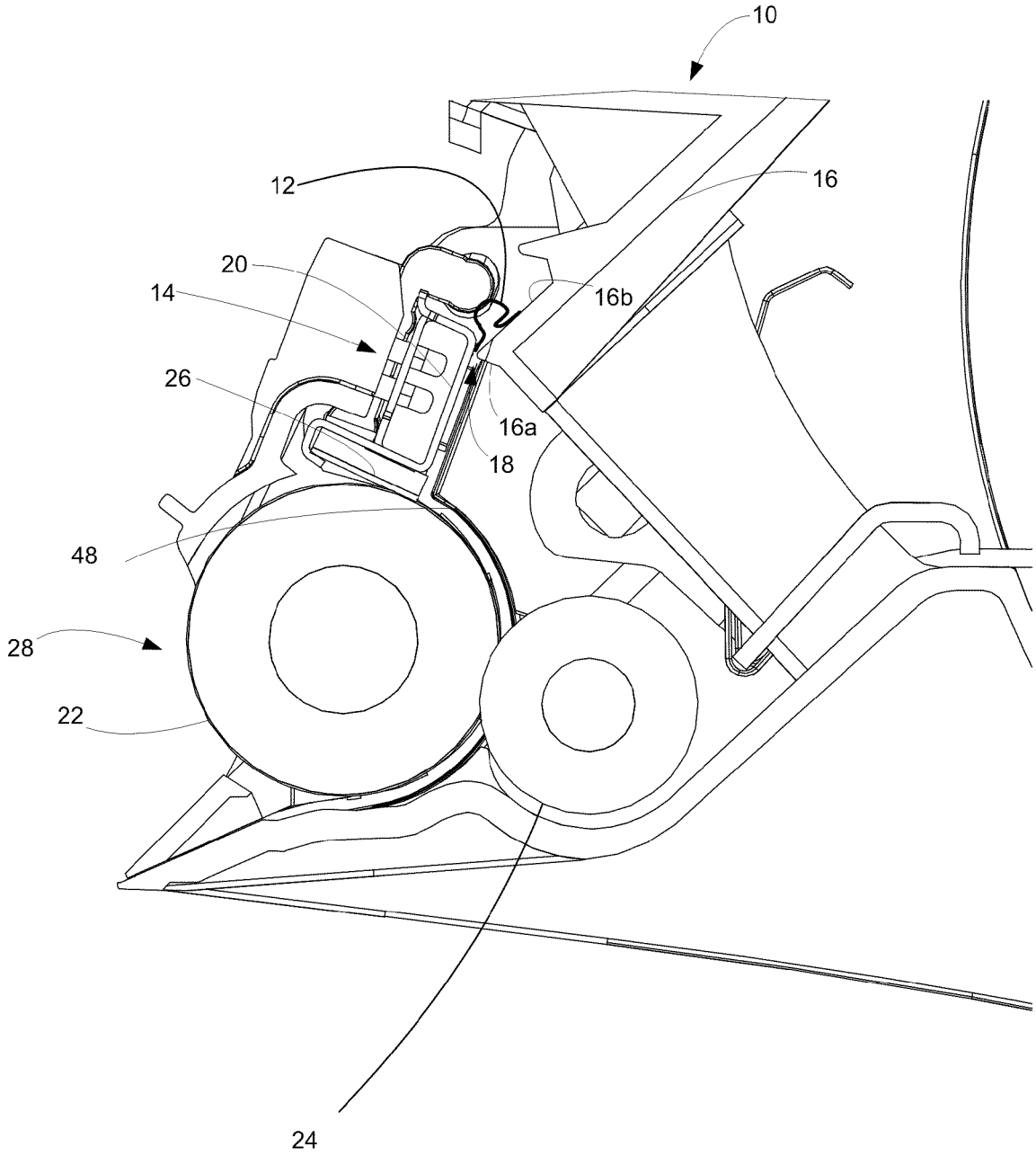
FIG. 2B PRIOR ART

FIG. 2B is a view similar to that of FIG. 2A but now showing the prior art seal of FIG. 1 dislocated to a blown-out position in which it assumes a wedged condition on top of the doctor blade assembly.

Figure 2C:
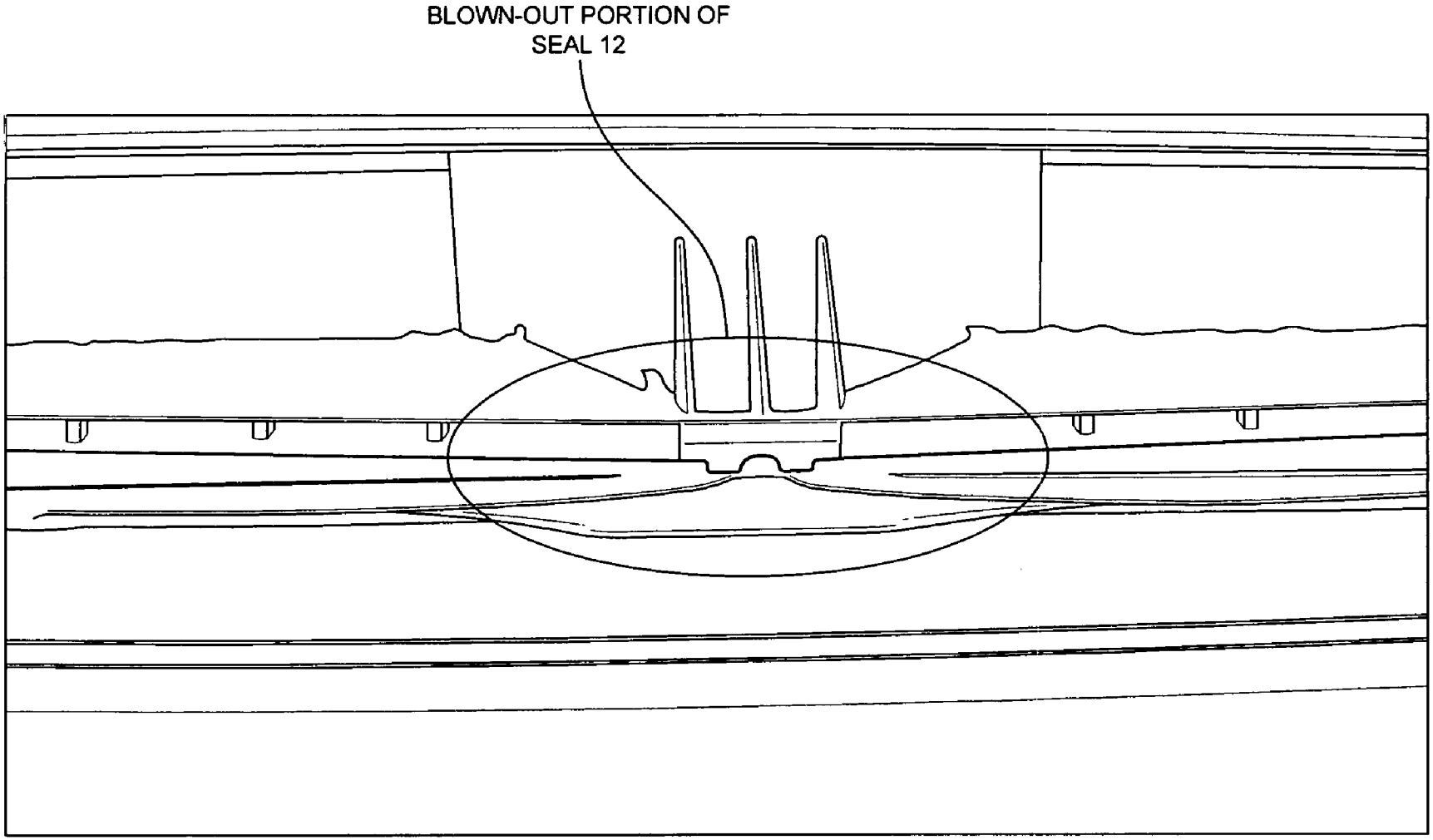
FIG. 2C Prior Art

FIG. 2C is a photograph of a blown-out doctor blade assembly seal.

Figure 3:
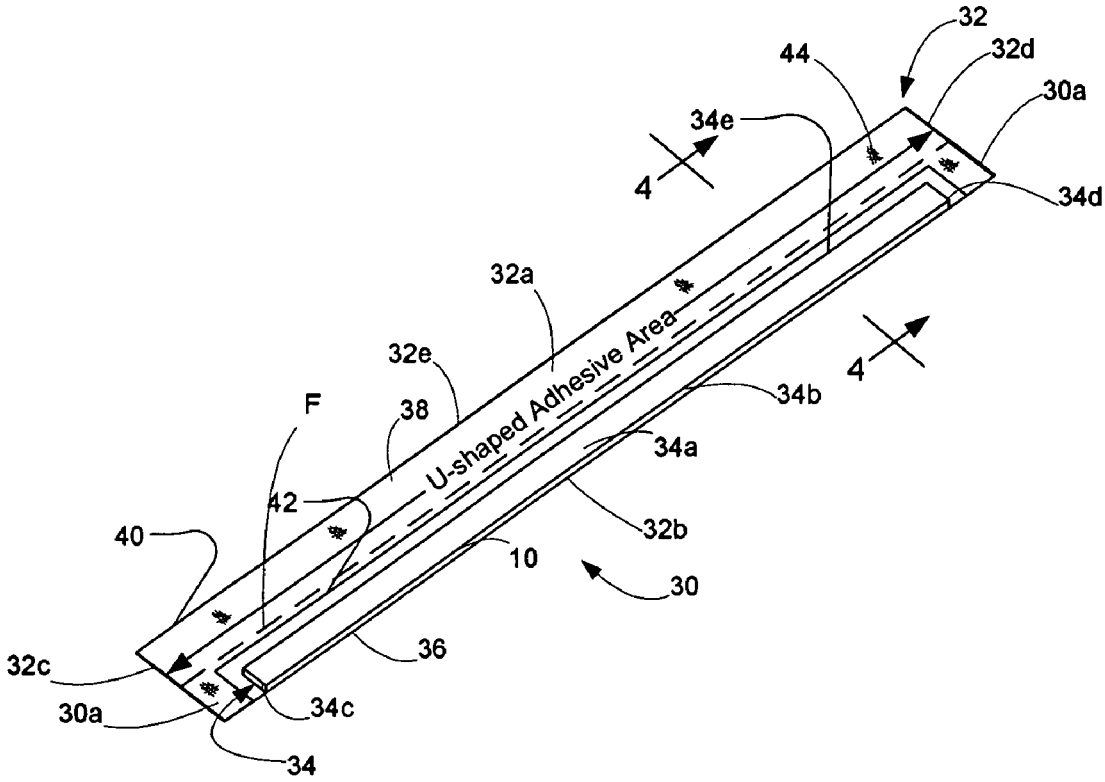

FIG. 3 is a perspective view an exemplary embodiment of a reinforced seal of the present invention.

Figure 4:
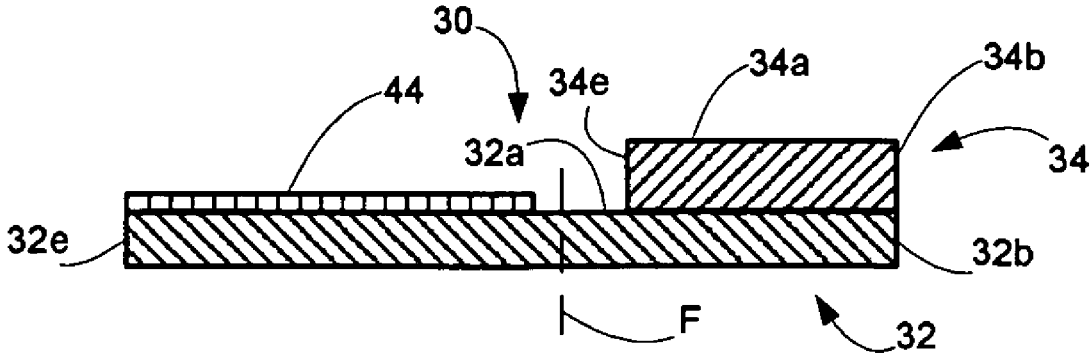

FIG. 4 is an enlarged cross-sectional view of the reinforced seal taken along line 4-4 of FIG. 3.

Figure 5:
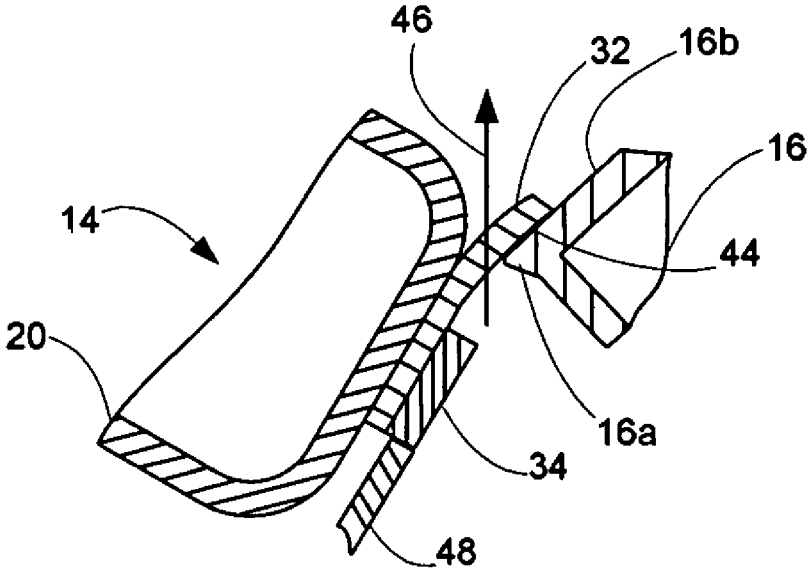

FIG. 5 is an enlarged fragmentary cross-sectional view of the reinforced seal extending in the sealing relationship in the gap between the doctor blade assembly and a corner portion on the printer cartridge housing.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Referring now to FIGS. 3-5, there is illustrated an exemplary embodiment of a reinforced seal of the present invention, generally designated 30, for sealably closing the gap 18 between the doctor blade assembly 14 and the housing 16 of the printer cartridge 10. The reinforced seal 30 basically has partially a single layered construction and partially a two layered, laminated construction, comprised of an elongated base strip 32 of a flexible plastic film and an elongated supplemental strip 34 of a flexible plastic film smaller in size than the base strip 32 and laminated, such as by being adhesively attached, on the base strip 32. The material comprising the flexible plastic film of both strips 32, 34, while not necessarily so limited, may be the same, a bi-axially-oriented polyethylene terephthalate (PET) polyester, or boPET polyester, which is also the same material used in the prior art seal of FIG. 1.

Both the base and supplemental strips 32, 34 of the reinforced seal 30 have polygonal configurations, preferably each rectangular in shape. The strips 32, 34 have respective surfaces 32*a*, 34*a* of predetermined areas bounded by multiple edges 32*b*-32*e*, 34*b*-34*e*, respectively, correspondingly adjacently positioned in spaced apart relationship to each other. In the exemplary embodiment illustrated in FIG. 3, the multiple edges 32*b*-32*e* and 34*b*-34*e* on the respective base and supplemental strips 32, 34 preferably are four in number. The area of the surface 32*a* of the base strip 32 is larger than the area of the surface 34*a* of the supplemental strip 34 such that the surface 32*a* of the base strip 32 has a U-shaped configuration and borders the supplemental strip 34 at a plurality, namely three, of its edges 34*c*-34*e*. The base strip 32 is thus provided with adjacent laminated and non-laminated portions, generally designated 36, 38, along opposite sides of a foldable region F (as represented by a dashed line) extending between one pair of edges 32*c*, 32*d* of the base strip 32 and spaced from and intermediately between another pair of edges 32*b*, 32*e* of the base strip 32. The base and supplemental strips 32, 34 are substantially aligned with one another along their respective one edges 32*b*, 34*b*.

The supplemental strip 34 is shorter in length and width than the base strip 32. The strips 32, 34 are relatively narrow in configuration with their respective lengths being much longer or larger than their widths. The U-shaped surface 32*a* of the base strip 32 further has a U-shaped outer portion 40 and a U-shaped inner portion 42 such that the U-shaped inner portion 42 bounds the plurality, namely three, of the multiple edges 34*b*-34*e* of the supplemental strip 34. The U-shaped outer portion 40 has an attaching mechanism, such as an adhesive coating 44, thereon and contains the foldable region F which is aligned with the gap 18 when the reinforced seal 30 is installed as shown in FIG. 5. The foldable or flexible region F per se is at approximately the same position as it was on the prior art seal shown in FIG. 1.

The base strip 32 has a thickness of approximately 0.051 mm, the same as the prior art seal 12. The supplemental strip 34 has a thickness of approximately 0.19 mm which is within a range of from three to four times the thickness of the base strip 32. The thickness of the base strip 32 provides sufficient flexure stiffness needed to press the non-laminated portion 38 of the base strip 32 of the reinforced seal 30 and the adhesive coating 44 thereon against an outside surface 16*b* of the housing 16 above the gap 18 with the supplemental strip 34 located below the gap 18 so as to prevent potential leakage of toner along the path of flow as represented by arrow 46 through the gap 18, as best seen in FIG. 5. The adhesive coating 44 on the base strip 32 enables it, the same as in the case of the prior art seal 12, to stick to the outside surface 16*b* of the housing 16, as shown in FIG. 2A.

Thus, the supplemental strip 34 is laminated on the base strip 32 as described above such that when the reinforced seal 30 is installed on the outside surface 16*b* of the housing 16 the adhesively-coated area of the base strip 32 alone extends above the corner 16*a*on the housing 16 where the base strip 32 adheres to the housing 16 while the supplemental strip 34 is located below the housing corner 16*a*. The foldable region F defined on the base strip 32 of the reinforced seal 30 is contiguous with the corner 16*a* of the housing 16 where the seal 30 is bent when in its installed position, as depicted in FIG. 5. Thus, the supplemental strip 34 does not come into any significant contact, if any, with the corner 16*a* nor cause any unintended repositioning of the doctor blade assembly 14. The supplemental strip 34 being laminated to the base strip 32 sufficiently stiffens and reinforces the partially laminated seal 30 of the present invention such that the shock load needed to cause a seal failure is now higher than the printer cartridge 10 is likely to experience during handling and shipping. The thickness of the reinforced seal 30 through the base and supplemental strips 32, 34 of the laminated portion 36 is greater than the width of the gap 18 which deters blow out of the reinforced seal 30 outward through the gap 18. As a result, the reinforced seal 30 is much more resistant to blowing out over the doctor blade assembly 14. Also, with this added stiffness or rigidity, the ease of installation of the reinforced seal 30 is also increased. Before the rigidity of the laminated construction was added, the entire length of the prior art seal 12 deflected under its own weight. Now, with the reinforced seal 30 being partially laminated construction, once the non-laminated portion 38 of the reinforced seal 30 is properly placed onto the housing 16, with the adhesive-covered opposite end portions 30*a* of the seal 30 overlapping J-seals 48 located at the opposite ends of the doctor blade assembly 14 and the developer roll 22, the middle unsupported laminated portion 36 of the reinforced seal 30 holds its generally planar shape due to the reinforcing presence of the supplemental strip 34 allowing for more precise placement of the reinforced seal 30 when being secured to the housing 16 of the printer cartridge 10.

The reinforced seal 30 tailors the solution provided by the present invention to meet the constraints of the problem that is faced. For example, merely increasing the thickness of the entire prior art seal 12 would not alleviate the problem. While a thicker boPET polyester film of the prior art seal 12 would be less prone to flexing when exposed to shock loads, it must not be so thick that the seal would yield and crease, as the thicker seal would do, when it is placed behind the doctor blade assembly. Just using a thicker seal is also not feasible because opposite end portions that overlap the J-seals 48 must remain thinner than the remainder of the seal to prevent a leak path across the J-seals 48 located adjacent the opposite end portions of the seal and so as not to dislocate the positioning of the doctor blade nip. In order to prevent the prior art seal 12 from creasing while positioned behind the doctor blade assembly 14, the prior art seal 12 to be effective would have to be provided with a variable thickness like the reinforced seal 30. Thus, it can be readily understood that the partial laminated construction of the reinforced seal 30 is tailored to address and satisfy all these design constraints without causing unintended adverse consequences.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A reinforced doctor blade assembly seal, comprising:

a base strip of a flexible plastic film having a thickness, a surface of predetermined area bounded by multiple edges, and a foldable region extending length-wise of said base strip between one pair of said multiple edges and spaced from and located intermediately between another pair of said multiple edges;

a supplemental strip of a flexible plastic film having a thickness and a surface of predetermined area bounded by multiple edges and being laminated onto said flexible plastic film of said base strip offset from and along one side of said foldable region on said base strip such that said base strip has laminated and non-laminated portions along opposite sides of said fold region with the thickness of the laminated portion being greater than the thickness of the non-laminated portion; and an adhesive layer on at least a section of said non-laminated portion of said base strip extending between said one pair of multiple edges of said base strip;

wherein the base strip, the supplemental strip and the adhesive layer form a unitary assembly.

2. The seal of claim 1 wherein said thickness of said supplemental strip is within a range of from three to four times greater than said thickness of said base strip.

3. The seal of claim 1 wherein said flexible plastic film of said supplemental strip is a bi-axially-oriented PET polyester.

4. The seal of claim 1 wherein said flexible plastic film of said base strip is a bi-axially -oriented PET polyester.

5. The seal of claim 1 wherein said predetermined area of said surface of said base strip is larger than said predetermined area of said surface of said supplemental strip.

6. The seal of claim 1 wherein one of said multiple edges of said supplemental strip is substantially aligned along one of said multiple edges of said base strip.

7. The seal of claim 1 wherein said multiple edges of said base strip that correspond to said multiple edges of said supplemental strip are greater in length respectively than said multiple edges of said supplemental strip such that said surface of said base strip is substantially U-shaped and borders said supplemental strip along a plurality of said multiple edges of said supplemental strip.

8. The seal of claim 7 wherein said U-shaped surface on said base strip has a U-shaped outer portion and a U-shaped inner portion such that said U-shaped inner portion bounds said plurality of said multiple edges of said supplemental strip.

9. The seal of claim 8 wherein said U-shaped outer portion is spaced from said plurality of said multiple edges of said supplemental strip.

10. The seal of claim 8 wherein said U-shaped outer portion has said attaching mechanism in the form of an adhesive coating thereon.

11. The seal of claim 8 wherein said U-shaped surface of said base strip has said foldable region in said U-shaped outer portion thereof and spaced from said U-shaped inner portion thereof.

12. The seal of claim 11 wherein said U-shaped outer portion of said U-shaped surface on said base strip has said attaching mechanism in the form of an adhesive coating thereon.

13. A printer cartridge, comprising:

a housing having a reservoir for holding toner;

a developer roll supported by said housing and operable to receive toner from said reservoir and transfer the toner to a photoconductive drum;

a doctor blade assembly supported by said housing adjacent to said developer roll and having a doctor blade and a bracket for positioning said doctor blade to form a nip with said developer roll to control the amount of toner metered onto said developer roll, said bracket also disposed adjacent a portion of said housing such that a gap is defined between said bracket and said housing portion; and a reinforced seal disposed through said gap to provide sealing of said gap between said bracket and said housing portion to prevent potential leakage of toner in a predetermined direction of flow through said gap and from said printer cartridge, said reinforced seal including:

a base strip of a flexible plastic film having a thickness, a surface of predetermined area bounded by multiple edges, and a foldable region extending length-wise of said base strip between one pair of said multiple edges and spaced from and located intermediately between another pair of said multiple edges, a supplemental strip of a flexible plastic film having a thickness and a surface of predetermined area bounded by multiple edges and being laminated onto said flexible plastic film of said base strip offset from and along one side of said foldable region on said base strip such that said base strip has adjacent laminated and non-laminated portions along opposite sides of said fold region with said laminated portion having a greater thickness than said adjacent non-laminated portion and with said laminated portion being located upstream of said gap relative to the direction of potential toner leakage flow and said non-laminated portion being located through said gap and downstream of said gap relative to the direction of potential toner leakage flow, and an adhesive layer on at least a portion of said surface on said non-laminated portion of said base strip adapting attachment of said reinforced seal at said non-laminated portion of said base strip to said housing at least downstream of said gap;

wherein the base strip, supplemental strip and adhesive layer form a unitary assembly.

14. The cartridge of claim 13 wherein said thickness of said supplemental strip is within a range of from three to four times greater than said thickness of said base strip.

15. The cartridge of claim 13 wherein said flexible plastic film of said supplemental strip is a bi-axially-oriented PET polyester.

16. The cartridge of claim 13 wherein said flexible plastic film of said base strip is a bi-axially-oriented PET polyester.

17. The cartridge of claim 13 wherein said multiple edges of said base strip that correspond to said multiple edges of said supplemental strip are greater in length respectively than said multiple edges of said supplemental strip such that said surface of said base strip is substantially U-shaped and borders said supplemental strip along a plurality of said multiple edges of said supplemental strip.

18. The cartridge of claim 17 wherein said U-shaped surface on said base strip has a U-shaped outer portion and a U-shaped inner portion such that said U-shaped inner portion bounds said plurality of said multiple edges of said supplemental strip.

19. The cartridge of claim 18 wherein said U-shaped surface of said base strip has said foldable region aligned with said gap and defined in said U-shaped outer portion of said base strip and spaced from said U-shaped inner portion thereof and said adhesive layer is on said U-shaped outer portion of said base strip.

20. A reinforced doctor blade assembly seal, comprising:

a base strip of a flexible plastic film having a thickness, a surface of predetermined area bounded by multiple edges, and a foldable region extending length-wise of said base strip between one pair of said multiple edges and spaced from and located intermediately between another pair of said multiple edges;

a supplemental strip of a flexible plastic film having a thickness and a surface of predetermined area bounded by multiple edges and being laminated onto said flexible plastic film of said base strip offset from and along one side of said foldable region on said base strip such that said base strip has laminated and non-laminated portions along opposite sides of said fold region with the thickness of the laminated portion being greater than the thickness of the non-laminated portion and said multiple edges of said base strip that correspond to said multiple edges of said supplemental strip being greater in length respectively than said multiple edges of said supplemental strip such that said surface of said base strip is substantially U-shaped and borders said supplemental strip along a plurality of said multiple edges of said supplemental strip; and an attaching mechanism on at least a section of said non-laminated portion of said base strip extending between said one pair of multiple edges of said base strip.

21. The seal of claim 20 wherein said U-shaped surface on said base strip has a U-shaped outer portion and a U-shaped inner portion such that said U-shaped inner portion bounds said plurality of said multiple edges of said supplemental strip.

22. The seal of claim 21 wherein said U-shaped outer portion is spaced from said plurality of said multiple edges of said supplemental strip.

23. The seal of claim 21 wherein said U-shaped outer portion has said attaching mechanism in the form of an adhesive coating thereon.

24. The seal of claim 21 wherein said U-shaped surface of said base strip has said foldable region in said U-shaped outer portion thereof and spaced from said U-shaped inner portion thereof.

25. The seal of claim 24 wherein said U-shaped outer portion of said U-shaped surface on said base strip has said attaching mechanism in the form of an adhesive coating thereon.

26. A printer cartridge, comprising:

a housing having a reservoir for holding toner;

a developer roll supported by said housing and operable to receive toner from said reservoir and transfer the toner to a photoconductive drum;

a doctor blade assembly supported by said housing adjacent to said developer roll and having a doctor blade and a bracket for positioning said doctor blade to form a nip with said developer roll to control the amount of toner metered onto said developer roll, said bracket also disposed adjacent a portion of said housing such that a gap is defined between said bracket and said housing portion; and a reinforced seal disposed through said gap to provide sealing of said gap between said bracket and said housing portion to prevent potential leakage of toner in a predetermined direction of flow through said gap and from said printer cartridge, said reinforced seal including:

a base strip of a flexible plastic film having a thickness, a surface of predetermined area bounded by multiple edges, and a foldable region extending length-wise of said base strip between one pair of said multiple edges and spaced from and located intermediately between another pair of said multiple edges, a supplemental strip of a flexible plastic film having a thickness and a surface of predetermined area bounded by multiple edges and being laminated onto said flexible plastic film of said base strip offset from and along one side of said foldable region on said base strip such that said base strip has adjacent laminated and non-laminated portions along opposite sides of said fold region with said laminated portion having a greater thickness than said adjacent non-laminated portion and with said laminated portion being located upstream of said gap relative to the direction of potential toner leakage flow and said non-laminated portion being located through said gap and downstream of said gap relative to the direction of potential toner leakage flow and said multiple edges of said base strip that correspond to said multiple edges of said supplemental strip being greater in length respectively than said multiple edges of said supplemental strip such that said surface of said base strip is substantially U-shaped and borders said supplemental strip along a plurality of said multiple edges of said supplemental strip, and an attaching mechanism on at least a portion of said surface on said non-laminated portion of said base strip adapting attachment of said reinforced seal at said non-laminated portion of said base strip to said housing at least downstream of said gap.

27. The cartridge of claim 26 wherein said U-shaped surface on said base strip has a U-shaped outer portion and a U-shaped inner portion such that said U-shaped inner portion bounds said plurality of said multiple edges of said supplemental strip.

28. The cartridge of claim 27 wherein said U-shaped surface of said base strip has said foldable region aligned with said gap and defined in said U-shaped outer portion of said base strip and spaced from said U-shaped inner portion thereof and said attaching mechanism in the form of an adhesive layer is on said U-shaped outer portion of said base strip.

* * * * *